US005983465A

United States Patent [19]

Wakai et al.

[11] Patent Number: 5,983,465

[45] Date of Patent: Nov. 16, 1999

[54] FASTENER TAPE AND STRINGER FOR A SLIDE FASTENER CHAIN

[75] Inventors: Tatsumi Wakai; Muchiji Shimono; Akira Takano; Yoshiharu Yamaguchi, all of Toyama-ken, Japan

[73] Assignee: YKK Corporation, Tokyo, Japan

[21] Appl. No.: 09/143,053

[22] Filed: Aug. 28, 1998

[30] Foreign Application Priority Data

Aug. 29, 1997 [JP] Japan ..... 9-234423

[51] Int. Cl.[6] ..... A44B 19/00

[52] U.S. Cl. ..... 24/392; 24/397; 24/403

[58] Field of Search ..... 24/392, 397, 399, 24/400, 403

[56] References Cited

U.S. PATENT DOCUMENTS

| | | | |
|---|---|---|---|
| 3,874,036 | 4/1975 | Yoshikawa | 24/392 |
| 4,144,899 | 3/1979 | Kays . | |
| 4,216,805 | 8/1980 | Akashi | 24/392 |
| 4,334,556 | 6/1982 | Frohlich et al. | 24/392 |
| 4,541,117 | 9/1985 | Ashbeck . | |
| 4,907,321 | 3/1990 | Williams | 24/399 |
| 5,020,206 | 6/1991 | Yoshida et al. . | |
| 5,172,456 | 12/1992 | Samberg et al. | 24/397 |

*Primary Examiner*—Victor N. Sakran
*Attorney, Agent, or Firm*—Hill & Simpson

[57] ABSTRACT

A colorful fastener tape for a slide fastener chain and a fastener stringer comprising such a fastener tape have an ornamental portion arranged along an inner longitudinal edge of the fastener tape and formed by multicolored yarns. A multicolored cord or a number of multicolored yarns are woven or knitted into the fastener tape 1 along the inner longitudinal edge to produce a thickened reinforced section, thus producing an ornamental portion such as of rainbow colored. Fastener elements of various types may be fitted to the reinforced section of the fastener tape of the a fastener stringer, thus the fastener stringer has a beautiful ornamental portion. When multicolored yarns are used for several warps or warp knitting yarns located adjacent to the reinforced section, a broadened ornamental portion can be produced to enhance the color effect of the fastener stringer that may be used for a dress to improve its color effect.

15 Claims, 7 Drawing Sheets

FASTENER TAPE AND STRINGER FOR A SLIDE FASTENER CHAIN

BACKGROUND OF THE INVENTION

1. Field of the Invention

This invention relates to a fastener tape for a slide fastener chain having a multicolored ornamental portion running along an inner longitudinal edge thereof and adapted to be exposed when the slide fastener is fitted to an article. It also relates to a fastener stringer for a slide fastener chain including such a fastener tape.

2. Prior Art

Conventional ornamental slide fasteners each bearing a pattern of design over the entire surface of a slide fastener chain including a pair of fastener elements are disclosed by, for example, Japanese Utility Model Laid-Open Publications Nos. Sho 52-47908 and Hei 6-9510.

With such a conventional slide fastener chain, since the fastener tapes is usually sewn to rear surfaces of edge portions of an opening of an article to which the slide fastener chain is attached, the pattern of design born over the entire front surface of each fastener tape was concealed by the cloth of the article and could not be seen. Consequently it was actually not necessary to provide the pattern of design over the entire front surface of each fastener tape.

Therefore, application of the conventional slide fasteners is limited. When the conventional slide fastener is attached to an article with its pattern of design concealed by the article, it would be very difficult to expose a delicate design or particular colors to such a restricted range as between the cloth edges of the article, and it would be laborious and time-consuming to provide the slide fastener chain including the fastener elements with the pattern of design.

SUMMARY OF THE INVENTION

In view of the above identified problem, it is therefore an object of the present invention to provide a fastener tape for a slide fastener chain, having a neat ornamental portion which is simple in structure and easy to be produced and which is adapted to be clearly exposed on the most conspicuous part, i.e. a center reinforced section of the slide fastener where fastener elements are secured when the slide fastener chain is attached to an article. The ornamental portion can be applied to various kinds of slide fasteners.

Further, it is another object of the invention to provide a fastener tape with an ornamental portion in a simple manner by specifying the coloring of the multicolored yarns or multicolored cord arranged at the reinforced section, in such a manner that the ornamental portion shows a multicolored regular pattern.

Furthermore, it is an object of the invention to provide a fastener tape with an ornamental portion by specifying a woven structure of the reinforced section, so that the reinforced section can be in various different modes.

Still further, it is an object of the invention to provide a fastener tape with an ornamental portion by specifying the arrangement of multicolored cord for forming the reinforced section of the fastener tape, so that the ornamental portion can hold fastener elements of various types.

Still further, it is an object of the invention to expand the ornamental portion by arranging multicolored yarns adjacent to the reinforced section in the fastener tape so that a colorful and attractive ornamental portion may be produced by the reinforced section and the additional multicolored yarns.

Still further, it is an object of the invention to provide a slide fastener tape with a flat woven or knitted ornamental portion along the inner longitudinal edge of the fastener tape, which is suitable for various kinds of fastener elements such as of a zigzag type or a coiled type.

Still further, it is an object of the present invention is to provide a fastener stringer having fastener elements of a specified type secured to the ornamental inner longitudinal edge of the fastener tapes as mentioned above so that the fastener elements can be attached efficiently in a simple manner.

Finally, it is an object of the invention to provide such a fastener stringer that the fastener elements secured to the fastener tape and the sewing threads used to secure the fastener elements to the fastener tape do not interfere with the color effect of the ornamental portion of the fastener tape, thus enhancing the overall color effect.

According to the invention, the above object is mainly achieved by providing a slide fastener tape for a slide fastener chain including along an inner longitudinal edge thereof a reinforced section for securing fastener elements, the reinforced section being formed by multicolored yarns or a multicolored cord sequentially colored in different colors, using dyes or pigments of different colors, to produce an ornamental portion.

Preferably, the reinforced section may be formed by multicolored yarns or a multicolored cord colored regularly with a predeteremined pitch in different colors, such as a rainbow color.

Further, the reinforced section may be formed to be a hollow weaving structure in which the multicolored yarns are arranged for warp yarns.

Alternatively, the reinforced section may be formed by the multicolored cord woven in a warp-wise direction by needles.

Still alternatively, the reinforced section may be formed by the multicolored cord knitted in a warp-wise direction.

Further, the fastener tape may include a further ornament portion formed by several warp-wise multicolored yarns arranged adjacent to the reinforced section. It is preferable that the further ornament portion appear integral with the ornamental portion on the reinforced section.

Furthermore, the fastener tape may include an ornamental portion formed along an inner longitudinal edge of the fastener tape by several warp yarns or several wales of warp knitting yarns to be covered by the fastener elements, and the several warp yarns or warp knitting yarns are sequentially colored in different colors using dyes or pigments of different colors.

Preferably, the fastener the several warp weaving or knitting yarns are regularly colored with a predetermined length in different colors using dyes or pigments of different colors. The several warp weaving or knitting yarns may be rainbow-colored.

According to the invention, there is also provided a fastener stringer for a slide fastener chain, comprising a fastener tape as mentioned above and metal fastener elements secured to the ornamental portion formed along the inner longitudinal edge of the fastener tape. The fastener elements may typically be made of an aluminum alloy or a zinc alloy.

Alternatively, the fastener stringer may comprise a fastener tape as mentioned above and thermoplastic resin fastener elements secured to the ornamental portion formed along the inner longitudinal edge of the fastener tape. The thermoplastic resin may typically be polyacetal, polyamide or polypropylene.

Still alternatively, the fastener stringer may comprise a fastener tape as mentioned above and thermoplastic resin monofilament fastener elements secured to the ornamental portion formed along the inner longitudinal edge of the fastener tape. The thermoplastic resin may typically be polyamide or polyester and the monofilament fastener elements are made to pinch the ornamental portion and secured to the latter by means of double-loop sewing threads.

It is preferable that the thermoplastic resin fastener elements are colorless and transparent.

Further, the colorless and transparent thermoplastic resin fastener elements may be secured to the ornamental portion by sewing, using colorless and transparent thermoplastic synthetic fiber sewing threads. The colorless and transparent threads may typically be double-loop threads.

DETAILED DESCRIPTION OF THE PREFERRED EMBODIMENTS

Embodiments of the present invention will now be described in greater detail by referring to the accompanying drawings.

Figure 1:
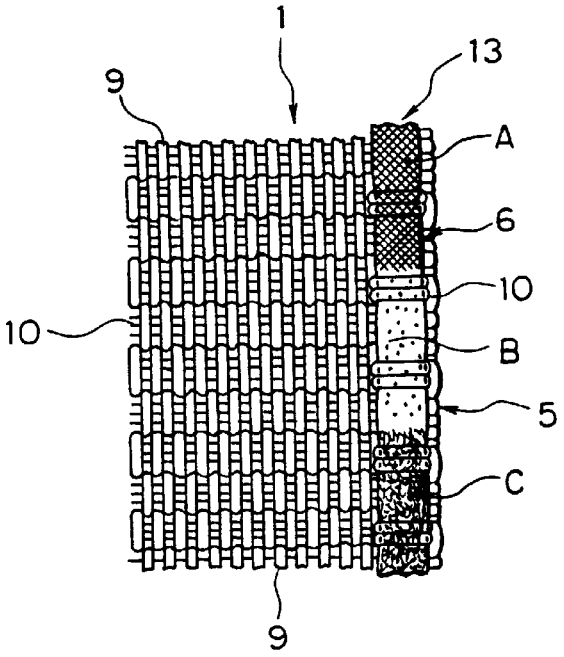
FIG. 1 is a schematic partial front view of a fastener tape for a slide fastener chain according to a first embodiment of this invention and comprising a reinforced section formed by a multicolored cord woven along an inner longitudinal edge of the fastener tape.

Firstly, embodiments of a fastener tape to be used for a slide fastener chain will be described. According to a first embodiment as shown in FIG. 1, the fastener tape 1 includes a reinforced section 5 woven by incorporating a round cord of a flux of thermoplastic resin threads that may be made of polyamide or polyester.

The round cord is sequentially colored in different colors such as red A, yellow B, green C, . . . by appropriate lengths, using several dyes or pigments of different colors, to produce a multicolored cord 6. The multicolored round cord 6 is then woven integrally with the fastener tape 1 at an inner longitudinal edge thereof to produce the reinforced section 5, thus producing an ornamental portion 13 along the inner longitudinal edge of the fastener tape 1. The round cord may be regularly colored in different colors at a predetermined pitch.

The multicolored cord 6 will remain clearly visible if the double-picked weft yarns 10 that are interlaced with the multicolored cord 6 are made of colorless and transparent synthetic fibers. The ornamental portion 13 will be emphasized if colorless or faint-colored synthetic fibers are used for the remaining warp yarns 9 and weft yarns 10 of the fastener tape 1.

Figure 2:
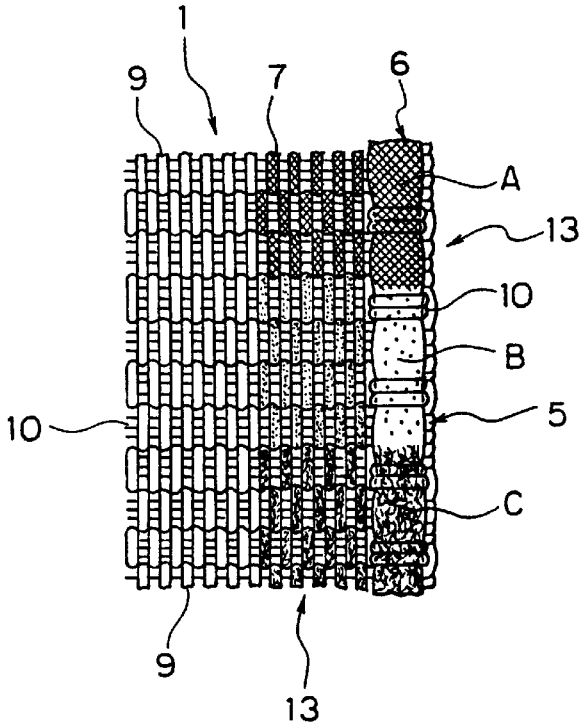
FIG. 2 is a schematic partial front view of a slide fastener tape according to a second embodiment of this invention and comprising a reinforced section formed by a multicolored cord and multicolored yarns arranged adjacent to the reinforced section.

FIG. 2 shows a fastener tape to be used for a slide fastener according to a second embodiment of this invention. The fastener tape 1 include a reinforced section 5 formed by a cord sequentially colored in different colors, using dyes or pigments of different colors, and woven into the fastener tape 1 along its inner longitudinal edge, thus producing an ornamental portion 13. Further, the fastener tape 1 includes another ornamental portion 13 adjacent to the reinforced section 5, which are formed of multicolored yarns 7 as warp yarns. The color effect of the multicolored yarns 7 will not be damaged when the weft yarns 10 that transverse the multicolored yarns 7 are made of colorless and transparent synthetic fibers because the visibility of the multicolored yarns 7 is not hindered by the weft yarns 10.

The multicolored yarns 7 are sequentially colored in different colors, using dyes or pigments of different colors, as in the case of the multicolored cord 6. Alternatively, the multicolored yarns 7 may be cyclically colored in different colors at a predetermined pitch. Though the ornamental portion 13 formed by the multicolored cord 6 and the multicolored yarns 7 may have any desired width, the width of the ornamental portions 13 are preferably greater than that of the fastener elements 4 secured to the inner longitudinal edge of the fastener tape 1 to make the ornamental portion 13 easily draw attention to it.

The multicolored yarns 7 may or may not be colored in harmony with the coloring of the multicolored cord 6. However, it may be preferable that the multicolored yarns 7 are colored in harmony with the coloring of the multicolored cord 6 to make the ornamental portion 13 attractive. It should be noted that the multicolored yarns 7 do not necessarily have to be arranged continuous to the multicolored cord 6 and may be separated from the multicolored cord 6 by several colorless warp yarns 9 arranged between the multicolored cord 6 and the multicolored yarns 7 to produce a gap in the ornamental portion 13, which does not damage the color effect.

Figure 3:
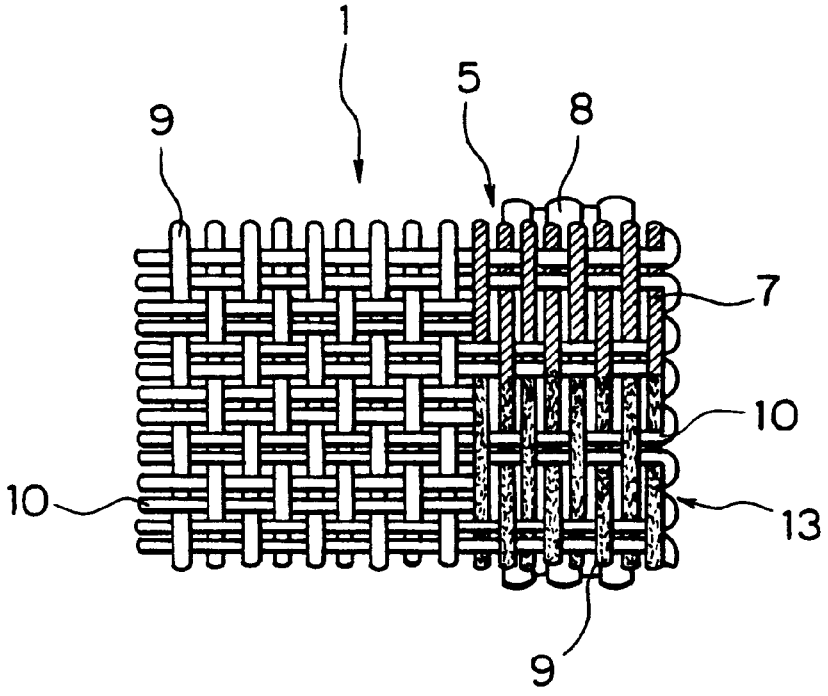
FIG. 3 is a schematic partial front view of a slide fastener tape according to a third embodiment of this invention and comprising a reinforced section having a hollow weaving structure woven by multicolored yarns.
Figure 4:
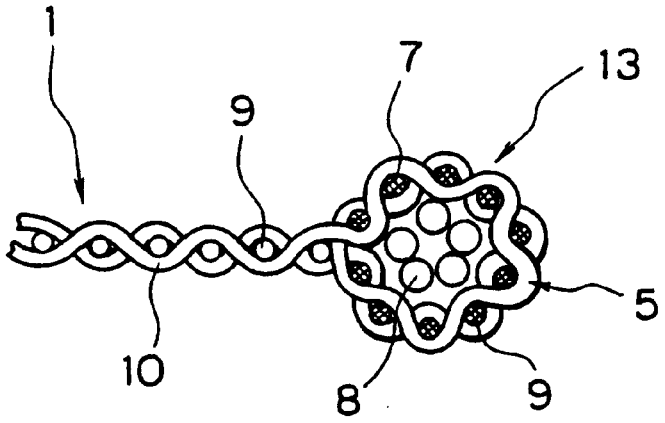
FIG. 4 is a schematic lateral cross sectional view of the slide fastener tape of FIG. 3.

In the fastener tape 1 as illustrated in FIGS. 3 and 4, which show a third embodiment of this invention, the reinforced section 5 is formed by a hollow weaving structure in which a flux of several core yarns 8 are arranged along an inner longitudinal edge of the fastener tape 1. The ornamental portion 13 of this fastener tape 1 is formed in the reinforced section 5 by multicolored yarns 7 as warp yarns 9 of the hollow weaving structure. The multicolored yarns 7 of the reinforced section 5 may or may not be colored in harmony relative to each other. However, it may be preferable that the multicolored yarns 7 of the reinforced section 5 are colored in harmony with each other to make the ornamental portion 13 attractive. The color effect of the multicolored yarns 7 will not be damaged when the remaining warp yarns 9 and weft yarns 10 of the fastener tape 1 are colorless or faint-colored to emphasize the colors of the ornamental portion 13.

Figure 5:
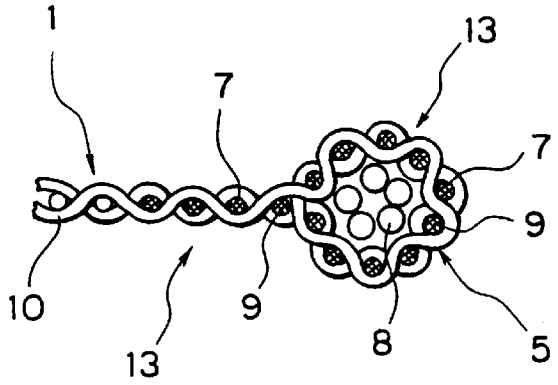
FIG. 5 is a schematic lateral cross sectional view of a slide fastener tape according to a fourth embodiment of this invention and comprising multicolored yarns arranged adjacent to a hollow-weaving reinforced section formed of multicolored yarns.

In the fastener tape 1 as illustrated in FIG. 5 which shows a fourth embodiment of this invention, a reinforced section 5 is formed by a hollow weaving structure in which core threads 8 are arranged along an inner longitudinal edge of the fastener tape 1, as the previous embodiment. The fastener tape 1 in this embodiment further has warp yarns 9 of multicolored yarns 7 adjacent to the reinforced section 5 to realize a broad ornamental portion 13, so that the ornamental portions 13, 13 of the reinforced section 5 and the remaining portion of the fastener tape 1 appear integral.

The width of the ornamental portion 13 of the multicolored yarns 7 is preferably made greater than that of the fastener elements 4 secured to the inner longitudinal edge of the fastener tape 1 to make the ornamental portion 13 easily draw attention to it. The multicolored yarns 7 may or may not be colored in harmony relative to each other. However, it may be preferable that the multicolored yarns 7 are colored in harmony with each other to make the ornamental portion 13 highly attractive.

Figure 6:
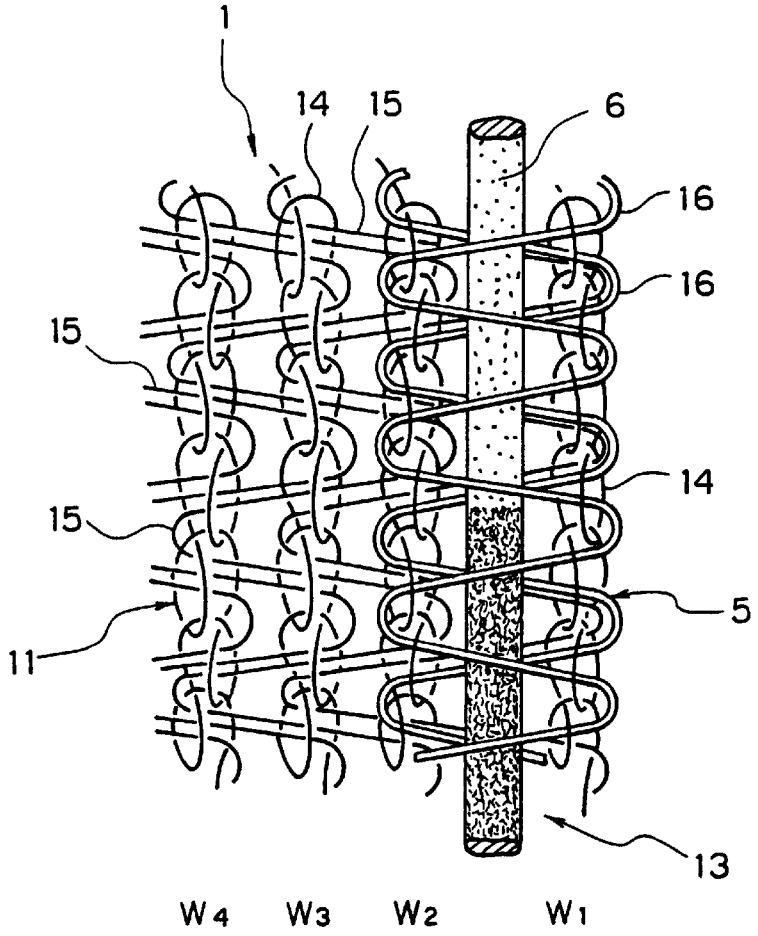
FIG. 6 is a schematic partial front view of a slide fastener tape according to a fifth embodiment of this invention and comprising a reinforced section knitted along an inner longitudinal edge of the fastener tape by a multicolored cord.

FIG. 6 shows a fastener tape 1 to be used for a slide fastener chain according to a fifth embodiment of the invention and comprising a reinforced section formed by knitting warp yarns. In all wales of the fastener tape 1, chain-stitch yarns 14 of 1-0/0-1 are arranged with weft inlaid yarns 15 of 0-0/3-3 interlaced therewith. A multicolored cord 6 is arranged between the wales $W_1$, and $W_2$ and intersected by weft inlaid yarns 16 of 0-0/1-1 arranged at the front and rear sides thereof to produce a reinforced section 5. The multicolored cord 6 is a round cord formed by a flux of synthetic fibers that are colored sequentially in several different colors, using dyes or pigments of different colors, to produce an ornamental portion 13 along an inner longitudinal edge of the fastener tape 1 that is colorful and attractive.

The color effect of the multicolored cord 6 will not be damaged when the inlaid weft yarns 16 of 0-0/1-1 arranged on the front side of the multicolored cords 6 are made of colorless and transparent synthetic fibers. A broad ornamental portion 13 will be produced by applying multicolored yarns 7 for the chain-stitch yarns 14 of the wales $W_1$, and $W_2$.

The ornamental portion 13 will be emphasized when white or pale synthetic fibers are used for all the remaining warp knitting yarns. The knit pattern of the fastener tape 1 of FIG. 6 may be modified appropriately. For example, the fastener tape 1 may be formed by combining tricot-stitch yarns of 1-2/1-0 and double-stitch yarns of 0-2/2-0.

Figure 7:
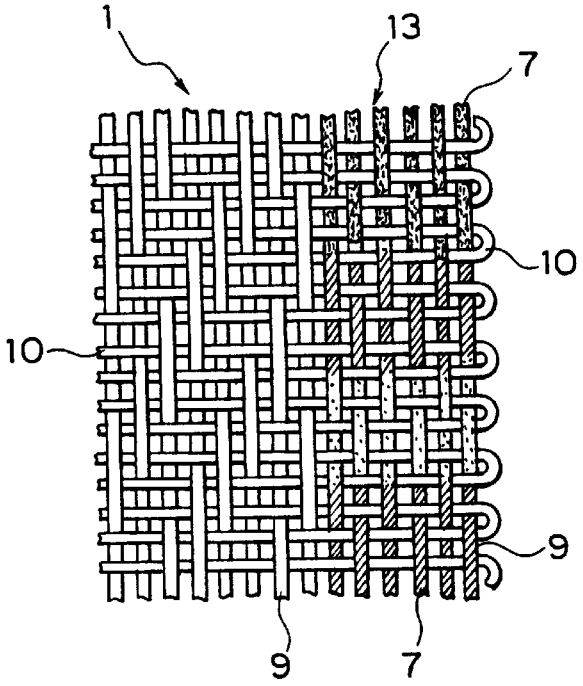
FIG. 7 is a schematic partial front view of a slide fastener tape according to a sixth embodiment of this invention and comprising a flat reinforced section formed along an inner longitudinal edge of the fastener tape by multicolored yarns.

The fastener tape 1 of FIG. 7 which shows a sixth embodiment of this invention, is realized by using multicolored yarns 7 for several warp yarns 9 arranged along an inner longitudinal edge of the flat fastener tape 1 that is made of cross-weave or plain-weave textile. The ornamental portion 13 of the fastener tape 1 is formed by arranging multicolored yarns 7 along the inner longitudinal edge of the fastener tape 1 to which fastener elements 4 secured so as to have a greater width than that of the fastener elements 4. Then, injection-molded fastener elements 4 or coiled or zigzag-shaped monofilament fastener elements 4 typically made of thermoplastic resin may suitably be secured to an inner longitudinal edge thereof. All the warp and weft yarns 9, 10 except for the multicolored yarns 7 may be colored in white or in faint color to advantageously emphasize the colors of the ornamental portion 13.

Now, a fastener stringer to be used for a slide fastener chain including a fastener tape according to the invention will be described below.

Figure 8:
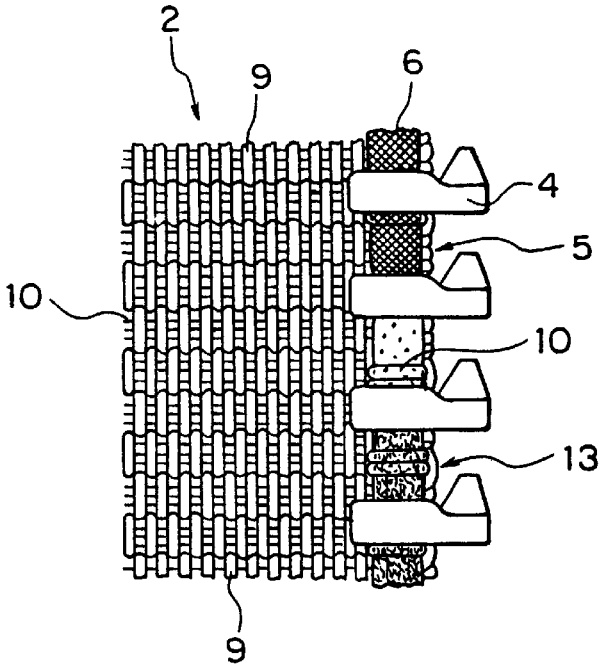
FIG. 8 is a schematic partial front view of a fastener stringer for a slide fastener chain according to a seventh embodiment of this invention and comprising metal fastener elements secured to the woven reinforced section formed by a multicolored cord.

FIG. 8 shows a fastener stringer 2 to be used for a slide fastener according to a seventh embodiment of this invention including metal fastener elements 4 secured to a woven reinforced section 5 of the fastener tape 1 formed by a multicolored cord as shown in FIG. 1. The fastener elements 4 are typically made of an aluminum alloy or a zinc alloy and fixed to the reinforced section 5. The ornamental portion 13 formed In the reinforced section 5 of the fastener tape 1 appears between the legs of the fastener elements 4 of the fastener stringer 2.

Figure 9:
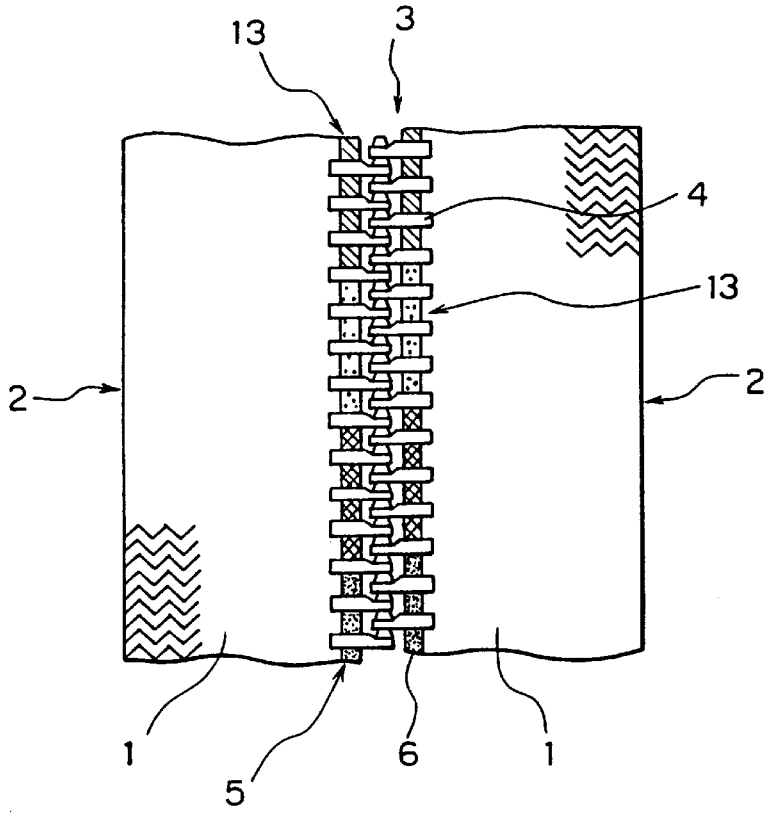
FIG. 9 is schematic partial front view of a slide fastener chain comprising a pair of fastener stringers as shown in FIG. 8.

FIG. 9 shows a slide fastener chain 3 comprising a pair of fastener stringers 2, 2 as mentioned above. Each fastener stringer 2 has metal fastener elements 4 held in engagement with those of the other stringer 2. The illustrated multicolored cords 6 of the opposed fastener stringers 2,2 are colored symmetrically and in harmony relative to each other. Alternatively, they may be colored asymmetrically to provide a unique color effect for the ornamental portions 13 of the fastener stringers 2.

Figure 10:
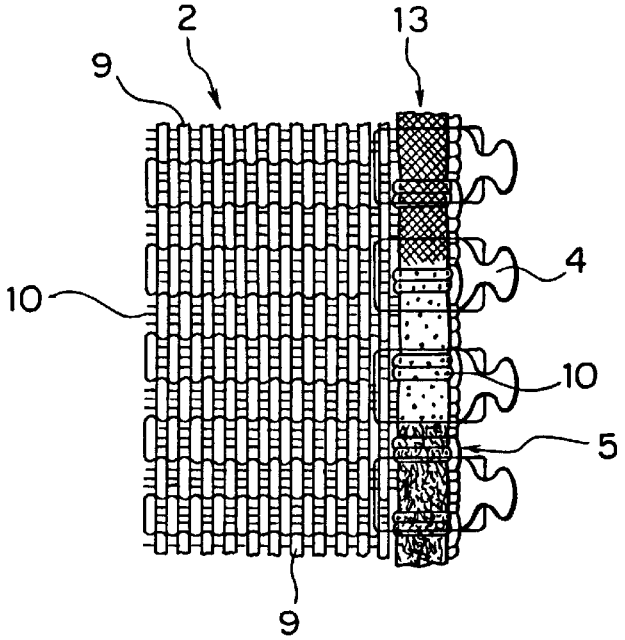
FIG. 10 is a schematic partial front view of a slide fastener stringer according to an eighth embodiment of this invention and comprising thermoplastic resin fastener elements secured to the woven reinforced section formed by a multicolored cord.

FIG. 10 shows a fastener stringer 2 to be used for a slide fastener according to an eighth embodiment of this invention. The fastener stringer 2 includes fastener elements 4 secured to a woven reinforced section 5 of the fastener tape 1 formed also by a multicolored cord as shown in FIG. 1. The fastener elements 4 are made of thermoplastic resin such as polyacetal, polyamide or polypropylene and formed on the reinforced section 5 by injection molding. The fastener elements 4 are preferably colorless and transparent so that the colors of the ornamental portion 13 in the reinforced section 5 may be clearly and attractively visible through the fastener elements 4, thus enhancing the color effect.

Figure 11:
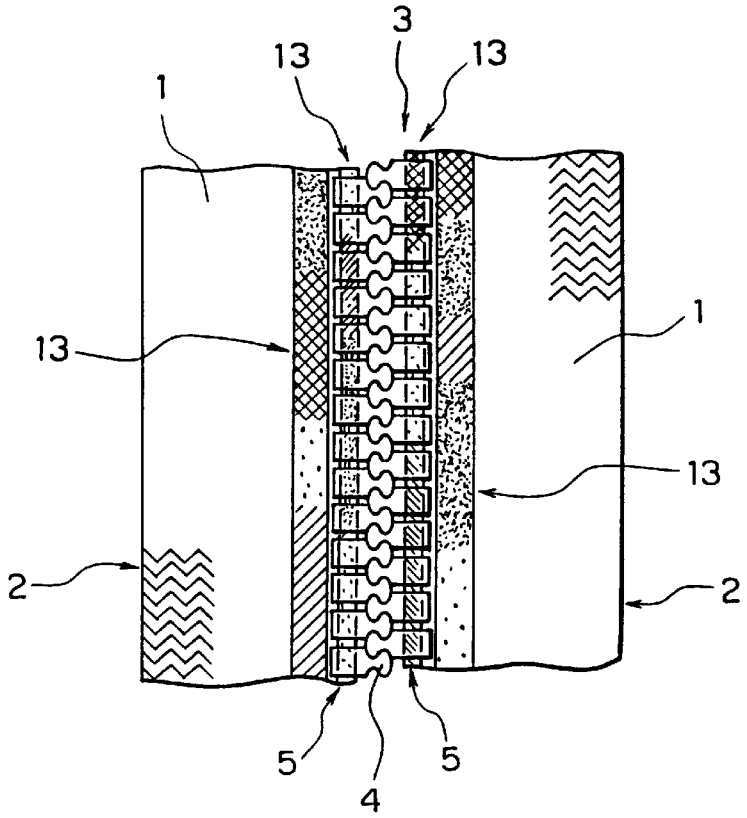
FIG. 11 is schematic partial front view of a slide fastener chain comprising a pair of fastener stringers according to a ninth embodiment of this invention, each stringer including a reinforced section formed by a multicolored cord and multicolored yarns arranged adjacent to the reinforced section.

FIG. 11 shows a slide fastener chain 3 including a pair of fastener tapes i, 1 as shown in FIG. 2, according to a ninth embodiment of this invention. Each stringer 2 includes a reinforced section 5 to which colorless and transparent fastener elements 4 of thermoplastic resin are secured by molding. Multicolored yarns 7 are used for several warps 9 arranged outside the secured and transparent fastener elements 4 to produce an ornamental portion 13 having a predetermined width on the fastener tape 1.

Though a narrow colorless portion is laid between the ornamental portions 13 of the multicolored cord 6 of the reinforced section 5 and the multicolored yarns 7, it does not affect the overall color effect of the slide fastener comprising such fastener chain. The oppositely is opposed ornamental portions 13 of multicolored yarns 7 of the paired fastener stringers 2, 2 may or may not be colored symmetrically and in harmony relative to each other.

Figure 12:
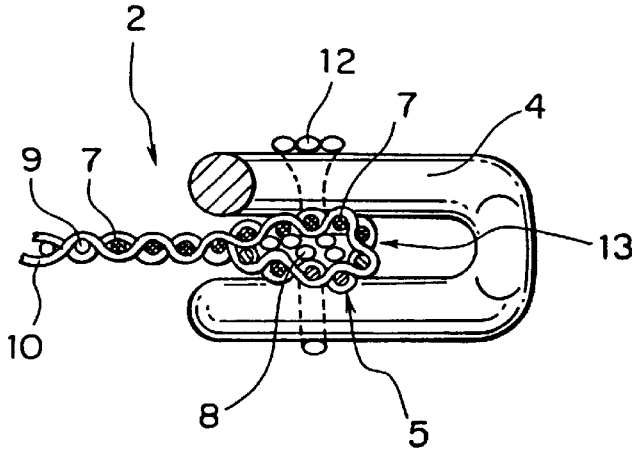
FIG. 12 is a schematic lateral cross sectional view of a slide fastener stringer according to a tenth embodiment of this invention and comprising monofilament fastener elements secured to the reinforced section by a hollow weaving structure of multicolored yarns.

FIG. 12 shows a fastener stringer 2 to be used for a slide fastener chain according to a tenth embodiment of this invention. The fastener stringer 2 includes fastener elements 4 secured by double-loop sewing threads 12 of two threads, which are sewn with a single needle, to the reinforced section 5 of the fastener tape 1 as shown in FIG. 5. The fastener tape 1 is formed by a hollow-weaving structure in which several core threads 8 are arranged. The fastener elements 4 are coiled or zigzag shaped and are made of synthetic fibers of polyamide or polyester.

Since the fastener tape 1 has several warp yarns 9 of multicolored yarns 7 arranged adjacent to the reinforced section 5 that is formed by warp yarns 9 of multicolored yarns 7, it will be seen that the ornamental portion 13 of this fastener stringer 2 is extended to the outside of the fastener elements 4. If the fastener elements 4 are monofilament fastener elements made of colorless and transparent synthetic fibers, the colors of the ornamental portion 13 will be clearly visible through the fastener elements.

Figure 13:
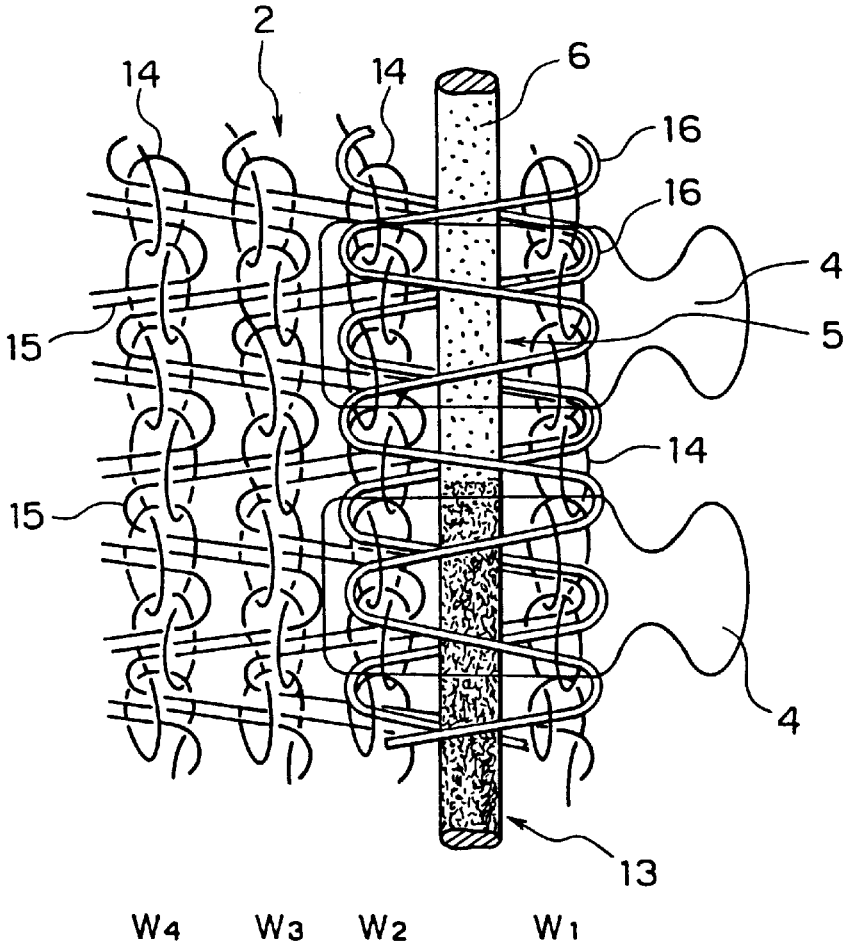
FIG. 13 is a schematic partial front view of a fastener stringer according to an eleventh embodiment of this invention and comprising thermoplastic resin fastener elements produced by injection molding and secured to the reinforced section knitted with a multicolored cord.

FIG. 13 shows a fastener stringer 2 to be used for a slide fastener chain according to an eleventh embodiment of this invention. The fastener stringer 2 includes thermoplastic resin fastener elements 4 secured to the reinforced section 5 of the fastener tape 1 knitted with a multicolored cord 6 as shown in FIG. 6. The fastener elements 4 are made of a thermoplastic resin material such as polyamide or polyacetal and formed by injection molding and are secured by chain-stitch yarns 14 of the wales $W_1$, and $W_2$ of the reinforced section 5. If the fastener elements 4 are made of colorless and transparent material, the colors of the ornamental portion 13 including the multicolored cord 6 will be clearly visible through the fastener elements 4.

Additionally, the ornamental portion 13 will show a large width to enhance the color effect of the slide fastener if multicolored yarns 7 are used for the chain-stitch yarns 14 of the wales $W_1$, $W_2$, $W_3$ arranged along an inner longitudinal edge of the fastener tape 1. An ornamental portion 13 having a unique color effect will be produced if the fastener elements 4 are made of an opaque thermoplastic resin material.

Figure 14:
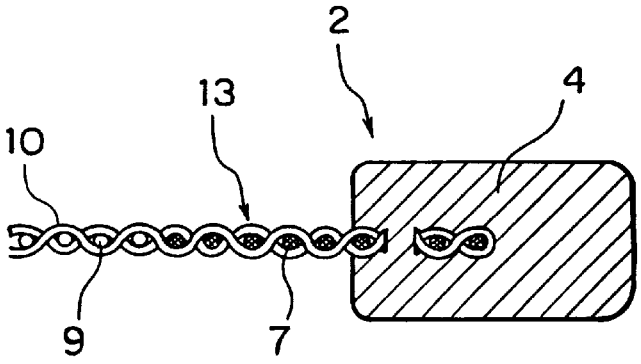
FIG. 14 is a schematic cross sectional view of a fastener stringer to be used for a slide fastener according to a twelveth embodiment of this invention and comprising thermoplastic resin fastener elements produced by injection molding and secured to the flat reinforced section of the fastener tape.

FIG. 14 shows a fastener stringer 2 to be used for a slide fastener chain according to a twelfth embodiment of this invention. The fastener stringer 2 includes thermoplastic resin fastener elements 4 secured to the flat reinforced section of the fastener tape 1 as shown in FIG. 7. The fastener tape 1 is produced by plain weave and includes an ornamental portion 13 formed by using multicolored yarns 7 for the several warps 9 arranged along the inner longitudinal edge of the fastener tape 1 where the fastener elements 4 are secured so that the ornamental portion 13 extends outside the fastener elements 4 by a predetermined width. The thermoplastic fastener elements 4 are formed by injection molding and the fastener tape 1 is provided with small holes for securely holding the fastener elements 4.

However, the fastener tape 1 may or may not be provided with small holes. If the fastener elements 4 are made of colorless and transparent material, the colors of the ornamental portion 13 will be clearly visible through the fastener elements 4.

A fastener tape 1 for a slide fastener chain and a fastener stringer having such a fastener tape according to this invention provides the following advantages.

Firstly, according to the invention, since there is provided a fastener tape 1 for a slide fastener chain, including along an inner longitudinal edge thereof a reinforced section 5 for securing fastener elements 4, and the reinforced section 5 is formed by multicolored yarns 7 or a multicolored cord 6 sequentially colored in different colors, using dyes or pigments of different colors, to produce an ornamental portion 13, a beautiful and attractive slide fastener chain of various kinds having such fastener tapes can be produced because fastener elements 4 can be securely and easily fitted to the fastener tape 1 and the reinforced section 5 of the fastener tape 1 has a neat ornamental portion 13, thus realizing an attractive slide fastener chain.

Further, since the reinforced section 5 is formed by multicolored yarns 7 or a multicolored cord 6 colored regularly in different colors, the slide fastener chain having ornamental portions colored regularly in different colors can be produced in a simple manner.

Furthermore, since the reinforced section 5 is formed to be a hollow weaving structure in which the multicolored yarns 7 are arranged for warp yarns 9, fastener elements 4 can be secured easily to the fastener tape 1 by sewing and an attractive slide fastener chain with neat ornamental portions 13 can be realized.

Still further, since the reinforced section 5 is formed by the multicolored cord 6 woven in a warp-wise direction, the reinforced section 5 with a neat ornamental portion 13 can be formed along the inner longitudinal edge of the fastener tape 1 by a simple weaving means.

Still further, since the reinforced section 5 is formed by the multicolored cord 6 knitted in a warp-wise direction, the reinforced section 5 with a neat ornamental portion 13 can be formed along the inner longitudinal edge of the fastener tape 1 by a simple knitting means.

Still further, since the fastener tape 1 includes a further ornament portion 13 formed by several warp-wise multicolored yarns 7 arranged adjacent to the reinforced section 5, the ornamental portion 13 has an enlarged width to improve the attraction of the slide fastener chain.

Still further, since the fastener tape 1 includes an ornamental portion 13 formed along an inner longitudinal edge of the fastener tape 1 by several warp yarns 9 or several wales of warp knitting yarns 11 to be covered by the fastener elements 4, and said several warp yarns 9 or warp knitting yarns 11 are sequentially colored in different colors using dyes or pigments of different colors, the slide fastener tape having attractive ornamental portions 13 but a simple structure can be produced by weaving or knitting.

Further, since the several warp yarns 9 or warp knitting yarns 11 are regularly colored with a predetermined length in different colors using dyes or pigments of different colors, the fastener tape 1 can appear further attractive because of the cyclic and regular coloring of the ornamental portion 13.

According to the invention, since there is provided a slide fastener stringer 2 for a slide fastener chain comprising such a fastener tape 1 as mentioned above and metal fastener elements 4 secured to the ornamental portion 13 formed along the inner longitudinal edge of the fastener tape 1, a very beautiful and attractive slide fastener chain can be obtained in a simple manner.

Further, since the fastener stringer 2 comprises such a fastener tape 1 as mentioned above and thermoplastic resin fastener elements 4 secured by injection molding to the ornamental portion 13 formed along the inner longitudinal edge of the fastener tape 1, a very beautiful and attractive slide fastener chain can be obtained in a simple manner.

Furthermore, since the slide fastener stringer 2 comprises such a fastener tape 1 as mentioned above and thermoplastic resin monofilament fastener elements 4 secured to the ornamental portion 13 formed along the inner longitudinal edge of the fastener tape 1 by sewing, a very beautiful and attractive slide fastener chain can be obtained in a simple manner.

Still further, since the injection-molded fastener elements or monofilament fastener elements are colorless and transparent, the color effect is much more enhanced, thus a very beautiful and attractive slide fastener comprising such fastener stringers 2 can be obtained.

Still further, since the colorless and transparent thermoplastic resin fastener elements 4 are secured to the ornamental portion 13 by sewing, using colorless and transparent synthetic fiber sewing threads 12, the ornamental portions 13 of the slide fastener stringers 2,2 are perfectly visible through the transparent fastener elements 4 and the transparent sewing threads 7 to enhance the color effect of the ornamental portions 13.

What is claimed:

1. A fastener tape for a slide fastener chain, comprising along an inner longitudinal edge thereof a reinforced section for securing fastener elements, said reinforced section being formed by one of multicolored yarns or a multicolored cord sequentially colored in different colors along a longitudinal length of said one of multicolored yarns or multicolored cord, an an ornamental portion defined by said reinforced section having the different colors.

2. A fastener tape for a slide fastener chain according to claim 1, wherein the reinforced section is formed by one of multicolored yarns or a multicolored cord colored regularly with a predetermined pitch in different colors.

3. A fastener tape for a slide fastener chain according to claim 1, wherein the reinforced section is formed to be a hollow weaving structure in which the multicolored yarns are arranged for warp yarns.

4. A fastener tape for a slide fastener chain according to claim 1, wherein the reinforced section is formed by the multicolored cord woven in a warp-wise direction.

5. A fastener tape for a slide fastener chain according to claim 1, wherein the reinforced section is formed by the multicolored cord knitted in a warp-wise direction.

6. A fastener tape for a slide fastener chain according to claim 1, wherein the fastener tape includes a further ornament portion formed by several warp-wise multicolored yarns arranged adjacent to the reinforced section.

7. A slide fastener stringer for a slide fastener chain, comprising a fastener tape according to claim 1 and metal fastener elements secured to the ornamental portion formed along the inner longitudinal edge of the fastener tape.

8. A slide fastener stringer for a slide fastener chain, comprising a fastener tape according to claim 1 and thermoplastic resin fastener elements secured to the ornamental portion formed along the inner longitudinal edge of the fastener tape.

9. A slide fastener stringer for a slide fastener chain according to claim 8, wherein the thermoplastic resin fastener elements are colorless and transparent.

10. A slide fastener stringer for a slide fastener chain according to claim 9, wherein the colorless and transparent thermoplastic resin fastener elements are secured to the ornamental portion by sewing, using colorless and transparent synthetic fiber sewing threads.

11. A slide fastener stringer for a slide fastener chain, comprising a fastener tape according to claim 1 and thermoplastic resin monofilament fastener elements secured to the ornamental portion formed along the inner longitudinal edge of the fastener tape.

12. A slide fastener stringer for a slide fastener chain according to claim 11, wherein the thermoplastic resin fastener elements are colorless and transparent.

13. A slide fastener stringer for a slide fastener chain according to claim 12, wherein the colorless and transparent thermoplastic resin fastener elements are secured to the ornamental portion by sewing, using colorless and transparent synthetic fiber sewing threads.

14. A fastener tape for a slide fastener chain, comprising an ornamental portion formed along an inner longitudinal edge of the fastener tape by one of several warp yarns or several wales of warp knitting yarns to be covered by the fastener elements, and said one of several warp yarns or warp knitting yarns are sequentially colored in different colors along a longitudinal length.

15. A fastener tape for a slide fastener chain according to claim 14, wherein the several warp yarns or warp knitting yarns are regularly colored with a predetermined length in different colors.

* * * * *

UNITED STATES PATENT AND TRADEMARK OFFICE

CERTIFICATE OF CORRRECTION

PATENT NO. : 5,983,465
DATED : November 16, 1999
INVENTOR(S) : Tatsumi Wakai, et al.

It is certified that error appears in the above-identified patent and that said Letters Patent is hereby corrected as shown below:

Title page, under item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 7 | 6 | 8 | 1 | 2 | 5 | 10-30-73 | Frohlich | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 1 | 1 | 5 | 6 | 7 | 2 | 6 | 5-20-58 | France | | | | X |
| | | 2 | 2 | 1 | 6 | 8 | 3 | 2 | 10-18-73 | Germany | | | | X |
| | | 2 | 3 | 0 | 2 | 0 | 5 | 9 | 9-24-76 | France | | | | X |
| | | 2 | 3 | 9 | 1 | 6 | 6 | 7 | 12-22-78 | France | | | | X |
| | | 2 | 4 | 2 | 7 | 8 | 0 | 4 | 1-4-80 | France | | | | X |
| | | 0 | 4 | 5 | 8 | 6 | 3 | 7 | 11-27-91 | Europe | | | | X |
| | | 0 | 5 | 9 | 1 | 6 | 5 | 4 | 4-13-94 | Europe | | | | X |
| | | | | | | | | | | | | | | |

Signed and Sealed this

Fifth Day of December, 2000

*Attest:*

*Attesting Officer*

Q. TODD DICKINSON

*Director of Patents and Trademarks*